US009183817B2

(12) United States Patent
Son

(10) Patent No.: US 9,183,817 B2
(45) Date of Patent: Nov. 10, 2015

(54) REED AFFIXING DEVICE FOR WIND INSTRUMENTS

(71) Applicant: Leto R&D Corporation, Hackensack, NJ (US)

(72) Inventor: Hye Lim Son, Closter, NJ (US)

(73) Assignee: Leto R&D Corporation, Hackensack, NJ (US)

( * ) Notice: Subject to any disclaimer, the term of this patent is extended or adjusted under 35 U.S.C. 154(b) by 0 days.

(21) Appl. No.: 14/451,605

(22) Filed: Aug. 5, 2014

(65) Prior Publication Data

US 2015/0059552 A1 Mar. 5, 2015

(30) Foreign Application Priority Data

Aug. 27, 2013 (KR) ..... 10-2013-0101763
Dec. 2, 2013 (KR) ..... 10-2013-0148381

(51) Int. Cl.
*G10D 9/02* (2006.01)

(52) U.S. Cl.
CPC . *G10D 9/023* (2013.01); *G10D 9/02* (2013.01)

(58) Field of Classification Search
CPC ..... G10D 9/02
See application file for complete search history.

(56) References Cited

U.S. PATENT DOCUMENTS 4,185,535 A * 1/1980 Lorenzini ..... 84/383 R
4,258,604 A 3/1981 Giokas
4,796,507 A 1/1989 Stibal
5,289,752 A * 3/1994 Barbaglia ..... 84/383 R
5,648,623 A * 7/1997 Silverstein et al. ..... 84/383 R
5,728,957 A * 3/1998 Valtchev ..... 84/383 R
7,169,993 B2 * 1/2007 Fliegel et al. ..... 84/383 A

FOREIGN PATENT DOCUMENTS

JP 6044190 6/1999
WO 8500916 2/1985

OTHER PUBLICATIONS

KIPO, Notice of Patent Allowance, Apr. 7, 2014.

* cited by examiner

*Primary Examiner* — Robert W Horn
(74) *Attorney, Agent, or Firm* — Kim Winston LLP

(57) ABSTRACT

Disclosed herein is a reed affixing device for a wind instrument. The device includes a puller means disposed on an upper portion of the mouthpiece in a longitudinal direction thereof and having a puller, with hollow portions formed in the puller in the longitudinal direction of the mouthpiece. A string-shaped cord passes through the hollow portions in the form of a unidirectional spiral from a side of the puller to wind around the reed and the mouthpiece at several times, and is secured to first and last hollow portions formed, respectively, in both ends of the puller. An affixing means is fastened to a side of the puller means to secure the reed to the mouthpiece. A pair of sound adjusting members is provided on opposite sides of the reed to be in close contact with the cord that is wound several times, thus adjusting a tone of sound.

18 Claims, 16 Drawing Sheets

REED AFFIXING DEVICE FOR WIND INSTRUMENTS

BACKGROUND OF THE INVENTION

1. Field of the Invention

The present invention relates to reed affixing devices for wind instruments, and, more particularly, to a reed affixing device for a wind instrument, which is intended to secure a reed to a mouthpiece of a wind instrument, such as a saxophone or a clarinet.

2. Description of the Related Art

Generally, a reed is coupled to a mouthpiece of a wind instrument, such as a saxophone or a clarinet, to produce the sound of the instrument via vibrations. There are various kinds of reeds classified according to the thickness or material thereof. Further, the reeds may make various tones. Thus, different kinds of reeds are used according to the style of music; for example, classical music, jazz or pop.

A player needs bright or dark sounds according to his or her preference or the characteristics of the music being played. To this end, the player selectively uses a thick reed for producing a dark sound or a thin reed for producing a bright sound. However, although the reed is selectively used as such, this method imposes limits upon the production of tones such that only one type of music can be played using a certain thickness of reed.

Further, the existing mouthpiece has various sizes. However, a cord of a ligature, which is currently used to secure the reed to the mouthpiece, has a length suitable for a specific mouthpiece. Since the length of the cord of the ligature which is currently available is limited, the ligature may be applied only to a specific kind of mouthpiece.

Moreover, the existing mouthpiece has various angles. Thus, there is required a ligature, which is configured to secure the reed to the mouthpiece of various angles in an accurate position and posture.

U.S. Pat. No. 5,648,623 discloses a ligature for woodwind instruments, which is intended to secure a reed to a mouthpiece of a wind instrument. In other words, the ligature for the woodwind instrument is configured to secure the reed to the mouthpiece using a cord.

However, the cited reference lacks a tone control function, which is capable of changing the tone between bright and dark, as necessary. Further, the cited reference is problematic in that there is no additional function of adjusting the length of the cord according to the size of the mouthpiece; therefore the ligature may be employed on only a very limited range of mouthpieces. Further, the cited reference is problematic in that it has no additional position control structure for securing the reed to mouthpieces of various angles in an accurate position and posture; consequently, the ligature may secure the reed to the mouthpiece in inaccurate position and posture if the mouthpiece has a large angle, thus causing inconvenience to a player.

DOCUMENTS OF RELATED ART (Patent Document 1) U.S. Pat. No. 5,648,623 (Jul. 15, 1997)

SUMMARY OF THE INVENTION

Accordingly, the present invention has been made keeping in mind the above problems occurring in the related art, and an object of the present invention is intended to propose a reed affixing device for a wind instrument, which has a tone control function of changing a tone into bright or dark sound as necessary.

Another object of the present invention is intended to propose a reed affixing device for a wind instrument, which is configured to conveniently adjust the length of a cord according to the size of a mouthpiece, thus being applicable to various kinds of mouthpieces.

A further object of the present invention is intended to propose a reed affixing device for a wind instrument, which is configured to secure a puller to a surface of a mouthpiece in a vertical state in an accurate position, through fine angle adjustment, regardless of the angle of the individual mouthpiece.

In order to achieve the above objects, according to one aspect of the present invention, there is provided a reed affixing device for a wind instrument intended to secure a reed to a lower portion of a mouthpiece provided on the wind instrument, the reed affixing device including a puller means disposed on an upper portion of the mouthpiece in a longitudinal direction thereof, and including a puller having a plurality of hollow portions formed in the longitudinal direction of the mouthpiece; a string-shaped cord passing through the plurality of hollow portions in the form of a unidirectional spiral from a side of the puller to wind around the reed and the mouthpiece at several times, the cord being secured to first and last hollow portions formed, respectively, in both ends of the puller; an affixing means fastened to a side of the puller means to secure the reed to the mouthpiece; and a pair of sound adjusting members provided on opposite sides of the reed in such a way as to be in close contact with the cord that is wound several times, and adjusting an interval to the reed, thus adjusting a tone of sound, wherein each of the sound adjusting members has a rectangular shape, and comprises on a first side thereof a plurality of through holes to come into close contact with the cord wound several times, the through holes having the same shape, the same surface area, and the same distance to a second side of the sound adjusting member.

According to another aspect of the present invention, there is provided a reed affixing device for a wind instrument intended to secure a reed to a lower portion of a mouthpiece provided on the wind instrument, the reed affixing device including a puller means disposed on an upper portion of the mouthpiece in a longitudinal direction thereof, and including a puller having a plurality of hollow portions formed in the longitudinal direction of the mouthpiece; a string-shaped cord passing through the plurality of hollow portions in the form of a bidirectional spiral with respect to a central portion of the puller to wind around the reed and the mouthpiece at several times, the cord being secured to first and last hollow portions formed, respectively, in both ends of the puller; an affixing means fastened to a side of the puller means to secure the reed to the mouthpiece; and a pair of sound adjusting members provided on opposite sides of the reed in such a way as to be in close contact with the cord that is wound several times, and adjusting an interval to the reed, thus adjusting a tone of sound, wherein each of the sound adjusting members has a rectangular shape, and comprises on a first side thereof, a plurality of through holes to come into close contact with the cord wound several times, the through holes having the same shape, the same surface area, and the same distance to a second side of the sound adjusting member.

The puller means may further include a pair of threaded holes formed perpendicularly to communicate with the first and last hollow portions, and having threads on inner circumferences thereof; and a pair of pressurizers coupled to the pair of threaded holes in a threaded fastening method to press and fix the cord.

The puller means may further include a guide bar extending upwards from the puller, with threads formed on an outer circumference thereof, the affixing means may include a bridge coupled to the guide bar, and a press lever located above the bridge and fastened to the guide bar in the threaded fastening method, the bridge may include a coupling depression, the coupling depression being depressed in a central portion of the bridge, and the press lever may include a coupling projection, the coupling projection protruding downwards to be coupled to the coupling depression, and each of the coupling projection and the coupling depression may have a spherical or hemi-spherical shape.

The reed affixing device may further include a plurality of cords having various thicknesses that are different from a thickness of the cord; and a plurality of puller means having a plurality of hollow portions that are fit for the cords of the various thicknesses, whereby a player may selectively use a cord and puller means corresponding thereto, according to his or her preference or a kind of an instrument.

The cord may be made of a Kevlar material.

The reed affixing device may further include at least one sleeve coupled to at least one of first and second ends of the cord, thus securing the end to the first or last hollow portion by press fitting.

The puller may include a pair of adjusting plates that are vertically separated from each other at the both ends thereof, with a space defined between the pair of adjusting plates to make each of the first and last hollow portions communicate with an outside, and the puller means may further include a pair of adjusters, the adjusters located on both sides of an upper portion of the puller and rotated to pressurize or release the pair of adjusting plates towards or away from each other.

Each of the hollow portions may include a protrusion, the protrusion protruding in a curved shape from a lower surface of the hollow portion defining a bottom, and a height from the protrusion to an upper surface of the hollow portion defining a ceiling may be equal to or larger than a diameter of the cord.

The reed affixing device may further include at least one affixing member secured to at least one of the first and second ends of the cord to lock the end to the first or last hollow portion, thus allowing a length of the cord to be adjusted depending on the size of the mouthpiece.

As is apparent from the above description, the reed affixing device for the wind instrument is advantageous in that it is provided with the sound adjusting member, so that it is possible to conveniently change the tone into a bright or dark sound as necessary, without replacing the reed with a different one. That is, this invention can obtain a desired exact tone by optimally changing the position of the sound adjusting member.

This reed affixing device for the wind instrument is advantageous in that it is configured to conveniently fasten or unfasten both ends of the cord, so that it is possible to conveniently adjust the length of the cord according to the size of the mouthpiece, and thereby the reed affixing device can be applied to various kinds of mouthpieces.

The reed affixing device for the wind instrument is advantageous in that it is possible to secure the puller to the surface of the mouthpiece in the vertical state in the accurate position, through the fine angle adjustment, regardless of the angle of the individual mouthpiece, thus allowing a player to play the instrument under the optimum environment.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Figure 1:
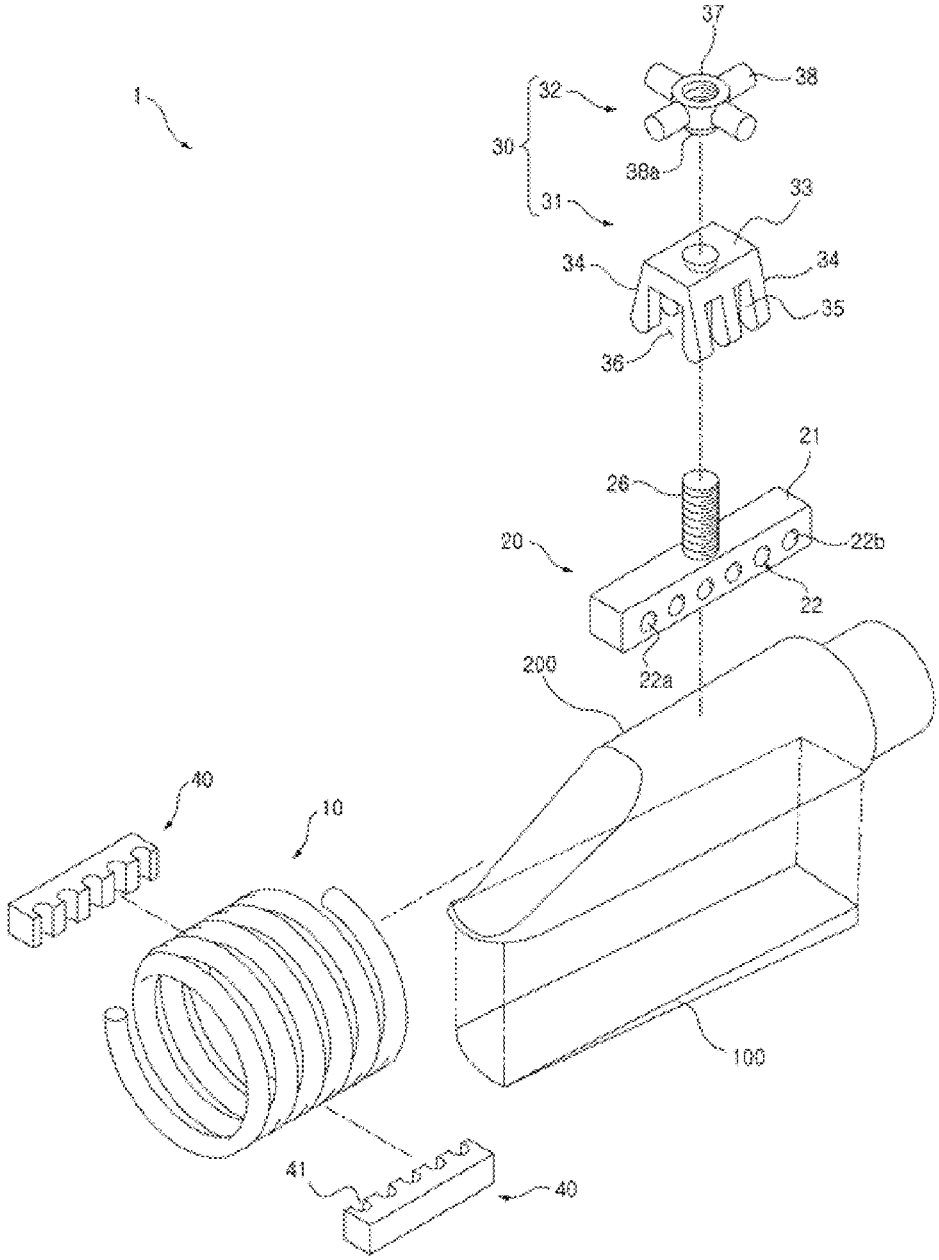
FIGS. 1 and 2 are an exploded perspective view showing a reed affixing device for a wind instrument according to a first embodiment of the present invention, and a view showing the state where a reed is secured to a mouthpiece, respectively.

Hereinbelow, the preferred embodiments of the present invention will be described in detail with reference to the accompanying drawings.

First Embodiment

As shown in FIGS. 1 to 11, the present invention relates to a reed affixing device 1 for a wind instrument, which is intended to secure a reed to a lower portion of a mouthpiece provided on the wind instrument. The reed affixing device 1 for the wind instrument according to the first embodiment of the present invention includes a cord 10 wound around a reed 100 and a mouthpiece 200, a puller means 20 disposed on an upper portion of the mouthpiece 200, with the cord 10 passing through the puller means 20 in the form of a unidirectional spiral, and an affixing means 30 fastened to the puller means 20 to secure the reed 100 to the mouthpiece 200. In this context, it is to be understood that the wind instrument includes a saxophone, a clarinet or the like. Since the reed 100 adopts a configuration that is known to those skilled in the art, the detailed description of the reed 100 will be omitted herein.

The cord 10 means a string that has both ends, extends in opposite directions, and has a vertical section of a circular shape. Preferably, the cord 10 is made of a Kevlar material.

Meanwhile, inventors(s) of the present invention verified that the sound of the instrument becomes bright or dark depending on the thickness of the cord 10, based on the result of tests that are performed together with several professional players. That is, according to the present invention, it is possible to change a tone by changing the thickness of the cord 10. To be more specific, the full section of the cord varying depending on the cord thickness limits the vibrating amplitude of the reed, and furthermore, determines a contact area of the cord and the reed. Thus, it is possible to change the vibrating amplitude and the vibration absorbing area of the reed, by changing the thickness of the cord. In conclusion, when the cord is thick, the vibrating amplitude of the reed is small and the vibration absorbing area thereof is wide, thus producing dark sound. In contrast, when the cord is thin, the vibrating amplitude of the reed is large and the vibration absorbing area is small, thus producing bright sound. Therefore, the present invention is advantageous in that it is possible to make bright sound or dark sound according to the player's preference by adjusting the thickness of the cord 10. When a player desires to adjust the thickness of the cord 10 as such, he or she has only to use the puller means 20 having a puller 21 in which a plurality of hollow portions 22 is formed, in conformity with the thickness of the cord 10.

Therefore, the reed affixing device 1 for the wind instrument according to the present invention is provided with a plurality of cords having several thicknesses and a plurality of puller means specifically configured for each cord according to cord thickness, so that a player may selectively use the cord and the puller means according to his or her preference or the kind of instrument.

The puller means 20 includes the puller 21, which extends at both ends thereof in a longitudinal direction of the mouthpiece 200 and has the plurality of hollow portions 22 formed in a direction crossing the longitudinal direction. Preferably, when the puller 21 is seated on the mouthpiece 200, a second end of both ends of the puller 21 faces the wind instrument, whereas a first end thereof extends in a direction opposite to the second end.

The puller 21 has an upper surface, a lower surface and side surfaces, the lower surface being seated on the upper portion of the mouthpiece 200. Further, the plurality of hollow portions 22 are formed through the side surfaces of the puller 21. Since each hollow portion 22 passes through the side surfaces of the puller 21, it is to be understood that both ends of the hollow portion 22 are located on the side surfaces of the puller 22.

The cord 10 moves from the first end to the second end of the puller 21 while a second end of the cord 10 moves in a vertical direction, that is, rotates towards the left or right. As the cord 10 advances, the second end of the cord 10 sequentially passes through the hollow portions 22 and winds around the mouthpiece 200 and the reed 10 in the form of a spiral. In other words, the second end of the cord 10 rotates towards the left or right in a direction crossing the longitudinal direction of the reed 100, from a first hollow portion 22*a* situated at the first end of the puller 21, thus simultaneously winding around both the mouthpiece 200 and the reed 100. In this way, the cord 10 moves sequentially to be introduced into a last hollow portion 22*b* situated at the second end of the puller 21.

Figure 3:
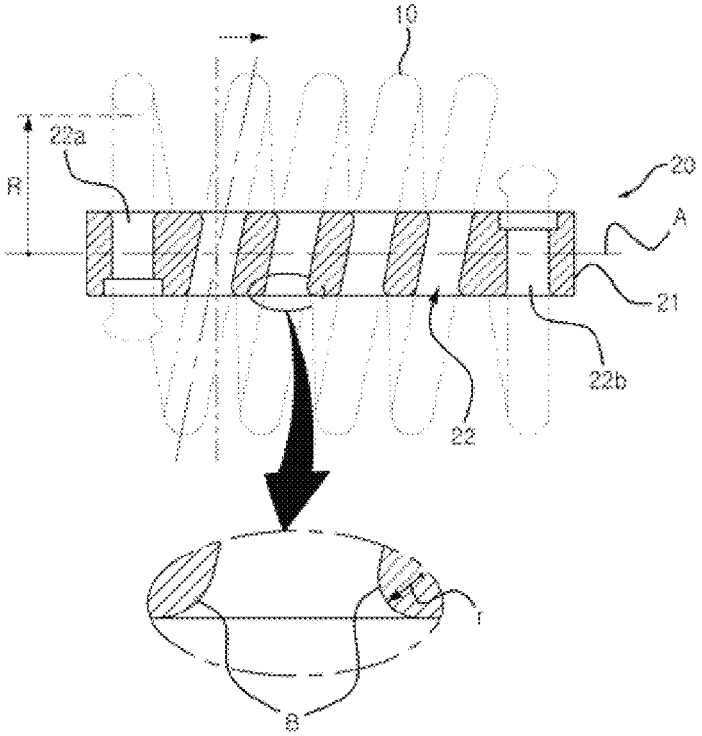
FIG. 3 is a cross-sectional view showing a puller in the reed affixing device for the wind instrument of FIG. 1.

Both ends of the cord 10 are secured to the first hollow portion 22*a* and the last hollow portion 22*b*, respectively. For example, as shown in FIG. 3, in the state where both ends of the cord 10 are located outside the hollow portions 22*a* and 22*b*, the ends may be secured to the hollow portions 22*a* and 22*b* by thermal fusion or the like to prevent the passage of the ends through the hollow portions 22*a* and 22*b*. In this case, each of the first and last hollow portions 22*a* and 22*b* is preferably formed to have different diameters at opposite sides thereof, thus allowing both ends of the cord 10 to be held in place by the first and last hollow portions 22*a* and 22*b*. Here, it should be understood that the first and last hollow portions 22*a* and 22*b* are oriented in opposite directions with respect to an imaginary central line A passing through a central axis of the puller 20.

Figure 4A:
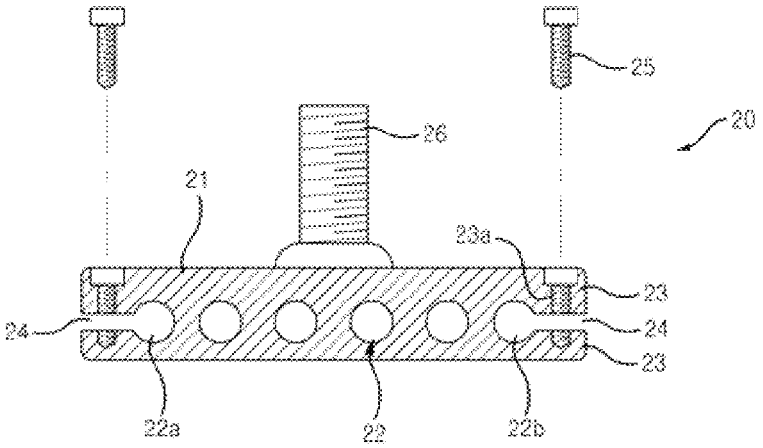
FIGS. 4A to 4C are vertical sectional views showing another example of a puller means in the reed affixing device for the wind instrument of FIG. 1, and a partial vertical sectional view showing a sleeve secured to the puller means.

As shown in FIG. 4A, the puller 21 is provided with a pair of adjusting plates 23 which are vertically separated from each other at both ends thereof. A space 24 is defined between the pair of adjusting plates 23 to make each of the first and last hollow portions 22*a* and 22*b* communicate with the outside.

The puller means 20 may further include a pair of adjusters 25 to pressurize or release the adjusting plates towards or away from each other. The adjusters 25 may comprise typical bolts, and are vertically coupled to upper portions of both ends of the puller 21. Threaded holes 23*a* are formed in inner circumferences of the adjusting plates 23 to allow the adjusters 25 to be fastened thereto in a threaded fastening method. Thus, as the adjusters 25 are rotated to be fastened to the adjusting plates 23, they adjust an interval between the adjusting plates 23. The adjustment allows both ends of the cord 10 to be pressurized or released.

Therefore, a user may apply the reed affixing device 1 for the wind instrument according to this embodiment to various mouthpieces by adjusting the adjuster 25 depending on the size of the mouthpiece 200 and thereby variably changing the length of the cord 10. For example, if the mouthpiece 200 is large in size, the adjusters 25 are adjusted such that the length of both ends of the cord 10 exposed to the outside through the first and last hollow portions 22*a* and 22*b* is reduced. In contrast, if the mouthpiece 200 is small in size, the adjusters 25 are adjusted such that the length of both ends of the cord 10 exposed to the outside through the first and last hollow portions 22*a* and 22*b* is increased.

Figure 4B:
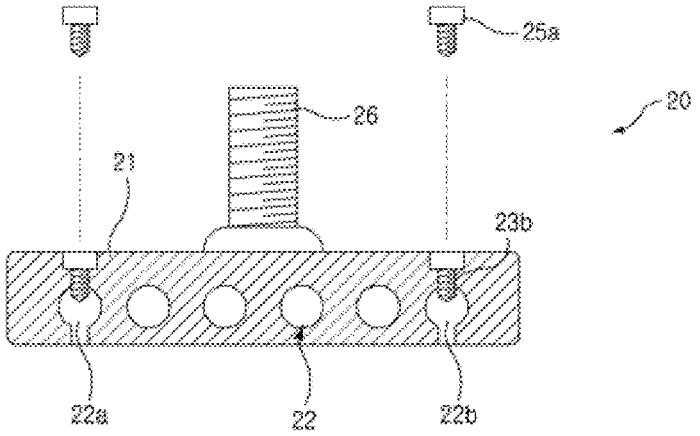

As shown in FIG. 4A, the puller 21 may secure the cord to the hollow portions 22*a* and 22*b* by deforming the first and last hollow portions 22*a* and 22*b* using the pair of adjusting plates 23 and the pair of adjusters 25. Alternatively, as shown in FIG. 4B, the puller 21 may secure the cord to the hollow portions 22*a* and 22*b* using a pair of threaded holes 23*b* that are formed perpendicularly to communicate with the first and last hollow portions 22*a* and 22*b* and have threads on inner circumferences thereof, and a pair of pressurizers 25*a* that are coupled to the pair of threaded holes 23*b* in the threaded fastening method to press and fix the cord 10.

Figure 4C:
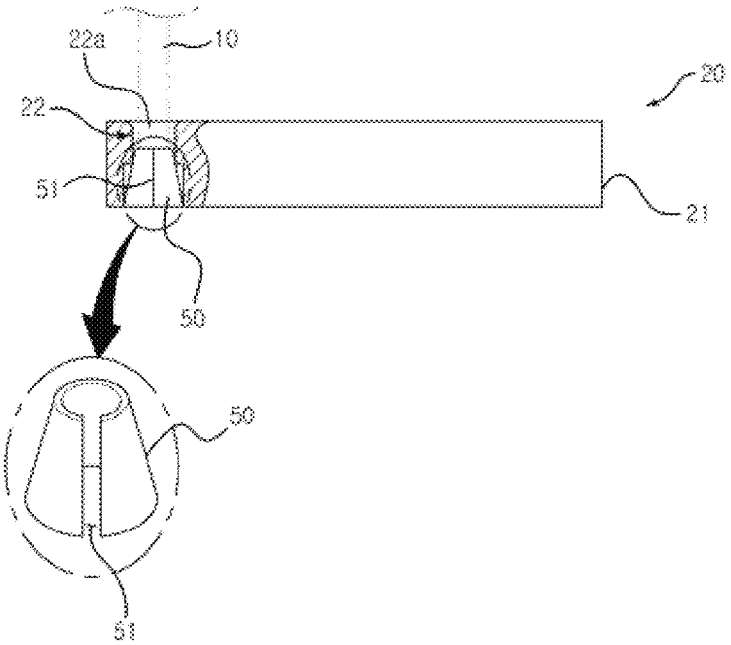

As shown in FIG. 4C, the reed affixing device 1 for the wind instrument according to this embodiment may further include a sleeve 50 for securing at least one of the first and second ends of the cord 10 to the first or last hollow portion 22*a* or 22*b* by press fitting. The sleeve 50 has the shape of a cone, both ends of which are spaced apart from each other to form a movable space 51 therebetween. It is to be understood that the movable space 51 is reduced as the sleeve 50 is fitted into the first or last hollow portion 22*a* or 22*b*.

In the state where at least one of the first and second ends of the cord 10 is coupled to the sleeve 50, it is secured to the first or last hollow portion 22*a* or 22*b* by press fitting. Thereby, it is possible to variably adjust the length of the end of the cord 10 which is drawn from the sleeve 50 in the first or last hollow portion 22*a* or 22*b* to be exposed to the outside, depending on the size of the mouthpiece 200.

Figure 4D:
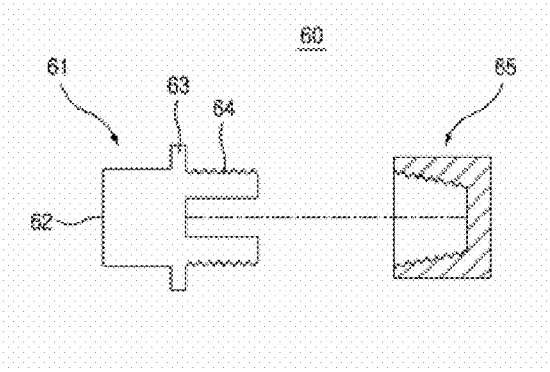
FIG. 4D is an exploded vertical sectional view showing an affixing member included in the reed affixing device for the wind instrument of FIG. 1.
Figure 4E:
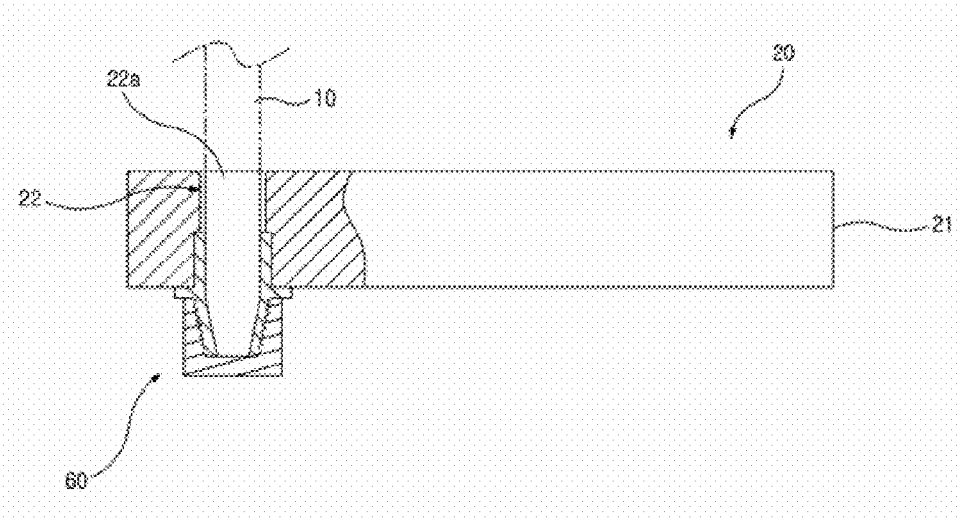
FIGS. 4E to 4I are partial vertical sectional views showing the state where the affixing member of FIG. 4D and other affixing members are secured to the puller.

Meanwhile, as shown in FIGS. 4D and 4E, the reed affixing device 1 for the wind instrument may further include at least one affixing member 60 which is secured to at least one of the first and second ends of the cord 10 to affix the associated end to the first or last hollow portion 22*a* or 22*b*.

The affixing member 60 includes a hollow screw 61 having threads on an outer surface of a side thereof, and a cap 65 fastened to threads of the hollow screw 61. The hollow screw 61 includes an inserting portion 62 that is inserted into part of the first or last hollow portion 22*a* or 22*b*, a flange 63 that is in close contact with a surface of the puller 21 around the first or last hollow portion 22*a* or 22*b*, and a coupling portion 64 that is provided on a side of the flange 63 to be opposite to the inserting portion 62, has threads on an outer surface thereof, and has at least two longitudinal slots.

The cap 65 has inner threads, which make the coupling portion 64 closed as the cap 65 is gradually coupled to the coupling portion 64, thus tightening the cord 10 fitted into the coupling portion 64 and thereby fixing the cord 10.

Figure 4F:
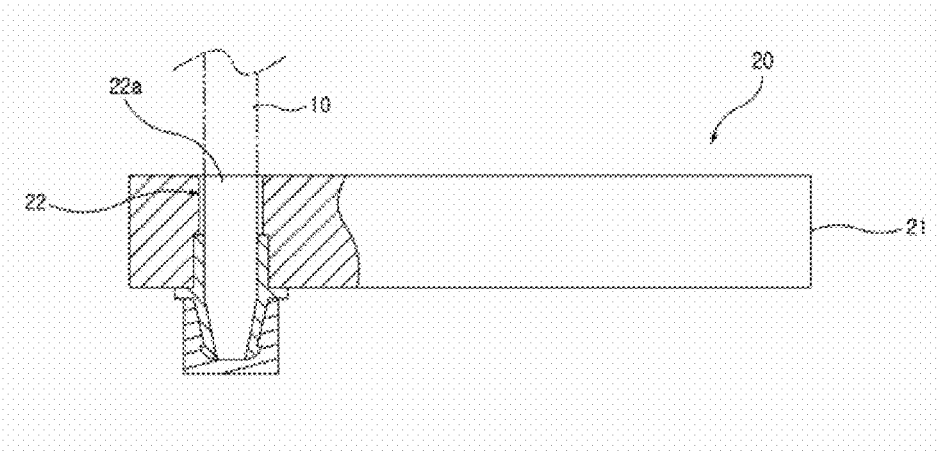
Figure 4G:
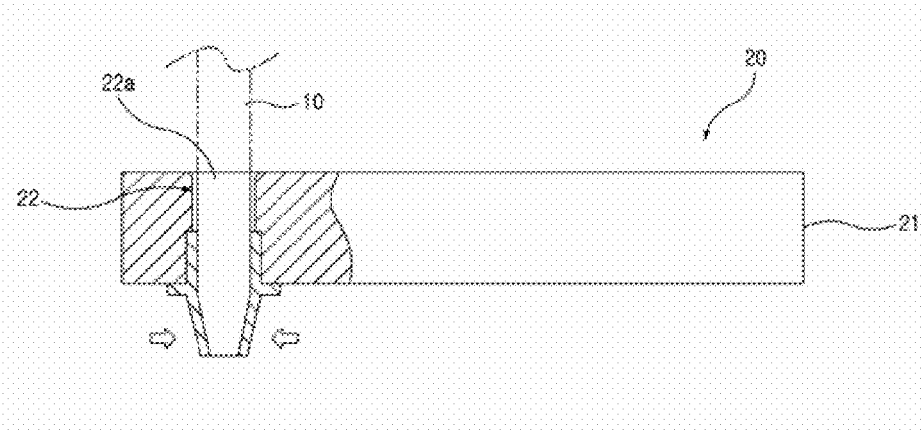
Figure 4H:
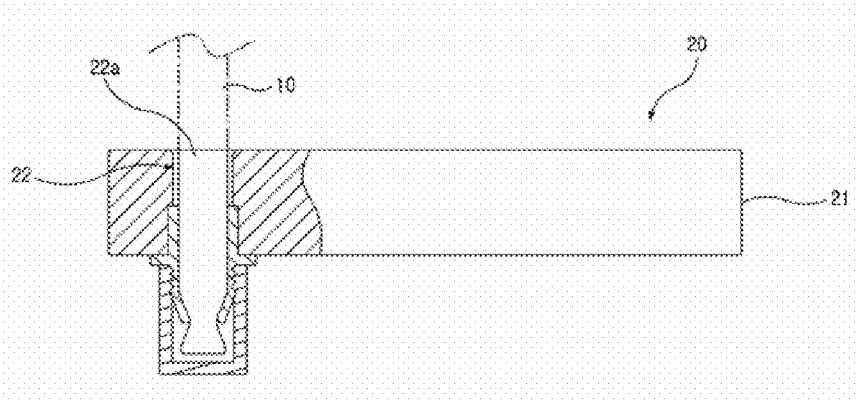
Figure 4I:
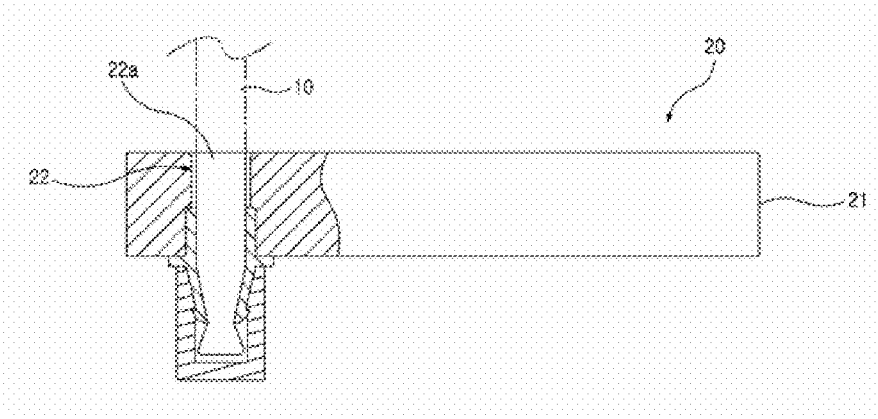

While maintaining the concept of FIG. 4D, the affixing member of the present invention may be configured as follows: the coupling portion of the hollow screw and the cap may adopt a one-touch locking structure instead of the thread fastening method as shown in FIG. 4F, the coupling portion of the hollow screw may be closed not by the cap but by a tool as shown in FIG. 4G, or the coupling portion of the hollow screw and the cap of FIGS. 4E and 4F may be partially changed in shape such that the end of the cord 10 is situated in the cap as shown in FIGS. 4H and 4I.

As shown in FIGS. 4E to 4I, as the affixing member 60 is secured to at least one of the first and second ends of the cord 10 to be fixed to the first or last hollow portion 22*a* or 22*b*, it is convenient to perform finishing in the state where the cord 10 is cut to an adjusted length depending on the size of the mouthpiece 200.

Preferably, the hollow portions 22 are formed not to be perpendicular to the longitudinal direction of the puller 21, thus guiding the cord 10 so that it may naturally pass through the hollow portions 22 in the form of a spiral, and uniformly transmitting a force to the cord 10 that passes through the hollow portions 22. In other words, as shown in FIG. 3, the plurality of hollow portions 22 are formed to be inclined towards the first or second end of the puller 21, with respect to the state when each hollow portion is perpendicular to the longitudinal direction of the puller 21. The reason is because the cord 10 is wound in the spiral form and thus is naturally inclined towards the first or second end of the puller 21, with respect to the state where it is perpendicular to the longitudinal direction of the puller 21.

Preferably, each hollow portion 22 is rounded at both ends thereof to form a curved surface B, thus allowing the cord 10 to pass through the hollow portion 22 without being bent. Each hollow portion 22 is preferably formed such that a radius r of the curved surface B is smaller than a radius R of circle of the cord 10 wound in the form of a spiral. This is based on the experiment. If the radius r is larger than the radius R, the cord 10 cannot stably hold the reed 100 due to the non-uniform distribution of the force. Thus, according to the present invention, when the radius r is smaller than the radius R, the cord 10 can stably hold the reed 100 owing to the uniform distribution of the force.

Figure 5:
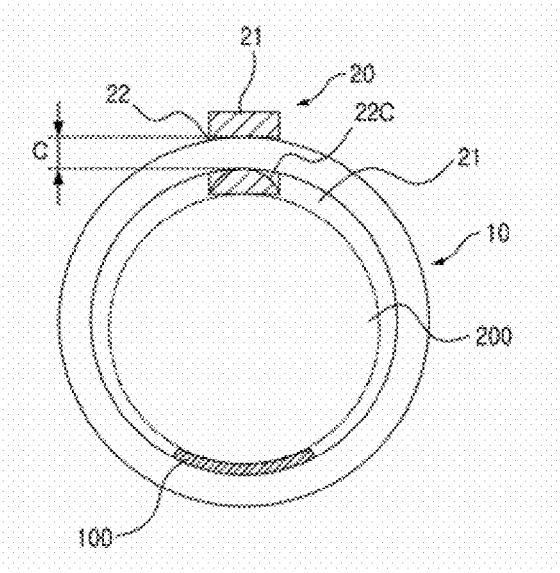
FIG. 5 is a partial vertical sectional view showing the state where a cord passes through a hollow portion in the form of a spiral in the reed affixing device for the wind instrument of FIG. 1.

As shown in FIG. 5, each hollow portion 22 may be provided with a protrusion 22*c* which protrudes from a bottom, namely, a lower surface of the hollow portion 22 in a curved form. Preferably, a height C from the protrusion 22*c* to a ceiling, namely, an upper surface of the hollow portion 22 is formed to be equal to or larger than the diameter of the cord 10. This prevents the cord 10 from being bent when passing through both ends of each hollow portion 22, thus solving a problem wherein the cord 10 cannot stably hold the reed 100 due to the non-uniform distribution of the force resulting from a loosened portion caused by the bending of the cord 10.

As shown in FIGS. 1, 2 and 6A to 6C, the reed affixing device 1 for the wind instrument according to this embodiment may further include a pair of sound adjusting members 40 which are provided on opposite sides of the reed 100, thus adjusting an interval to the reed 100 and a vibration absorbing region of the cord 10, and thereby adjusting a tone. The cord 10 according to this embodiment functions to absorb vibrations of sound emitted from the reed 100. Meanwhile, the tone is determined depending on the length of the cord 10 absorbing vibrations. That is, in the case of the cord 10 having a long vibration absorbing region, the cord 10 absorbs a large amount of vibrations emitted from the reed 100. In contrast, in the case of the cord 10 having a short vibration absorbing region, the cord 10 absorbs a small amount of vibrations emitted from the reed 100.

The pair of sound adjusting members 40 according to this embodiment serves to optionally adjust the length of the vibration absorbing region of the cord 10 absorbing vibrations. That is, if the sound adjusting members 40 are pushed down towards the reed 100, they absorb a small amount of vibrations from the reed. Meanwhile, if the sound adjusting members 40 are pushed upwards to be away from the reed 100, they absorb a large amount of vibrations from the reed. Here, the sound adjusting members 40 are integrally formed of the same material.

Figure 6A:
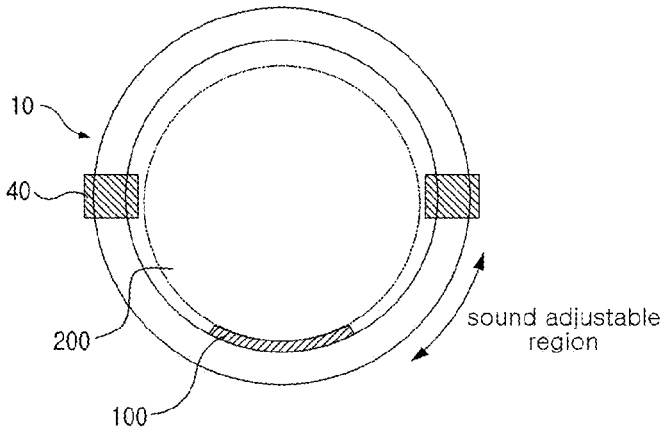
FIGS. 6A to 6C are conceptual views showing the absorption of vibrations using a pair of sound adjusting members in the reed affixing device for the wind instrument of FIG. 1.
Figure 6B:
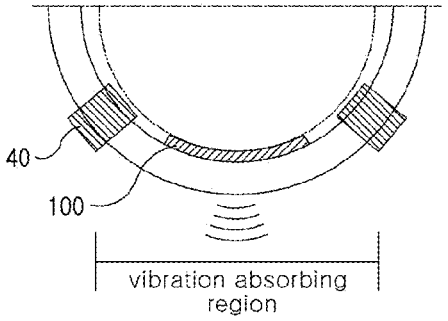
Figure 6C:
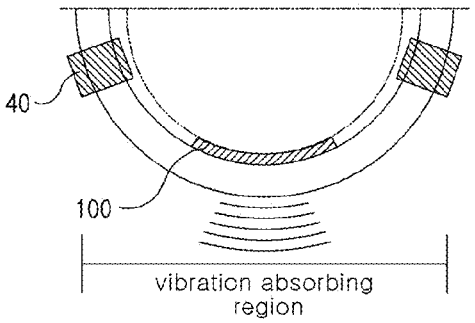

For example, when the length of the vibration absorbing region for absorbing vibrations from the reed becomes short as shown in FIG. 6B, vibrations generated on both ends of the reed are suppressed, so that sound is concentrated on the center and thereby bright sound is produced. However, when the length of the vibration absorbing region for absorbing vibrations from the reed becomes long as shown in FIG. 6C, vibrations generated on both ends of the reed are not suppressed and thereby sound spreads widely. Consequently, dark sound is obtained.

In order for the cord of each vibration absorbing region to evenly absorb vibrations, the contact shape of the sound adjusting member 40 with the cord 10 and the size of the sound adjusting member 40 at each cord should be constant. That is, a surface area of the sound adjusting member 40 meeting each cord and a vibration absorbing range should be constant. Thus, each sound adjusting member 40 according to the embodiment is configured to have a rectangular shape, with a through holes 41 formed in one side of the sound adjusting member 40 so that the cord 10 passes through and comes into contact with the through holes 41. Here, the through holes 41 are constant in shape and surface area, and vibration absorbing ranges corresponding to distances from the through holes 41 to the other side of the sound adjusting member 40 are also constant. Each through hole 41 has the shape of a circle which is open at a side thereof.

The pair of sound adjusting members 40 allows the cord 10 to be wound in the form of a spiral while maintaining a constant pitch through the through holes 41.

Meanwhile, although one example of adjusting a tone using the pair of sound adjusting members 40 is explained in this embodiment, it may be also possible to adjust the tone to which is desired using two pairs or more of sound adjusting members 40.

The reed affixing device 1 for the wind instrument according to the present invention may further include an additional member to support the cord 10 such that it is wound in the form of a spiral while maintaining the constant pitch, in addition to the sound adjusting members 40. In this case, the additional member and the sound adjusting members perform only their inherent roles.

Meanwhile, the experiment carried out by the inventor(s) of the present invention shows that the through hole 41 of the sound adjusting member 40 should have the surface area of at least 5.5 mm*3.5 mm, and the through hole 41 should be designed to have the diameter of at least 2.5 mm because it is sufficient to cover the region of the cord 10. In view of the absorption of vibrations and the convenience of manufacturing, the sound adjusting member 40 is preferably made of a metal material, but may be made of SUS or Bronze.

Figure 7:
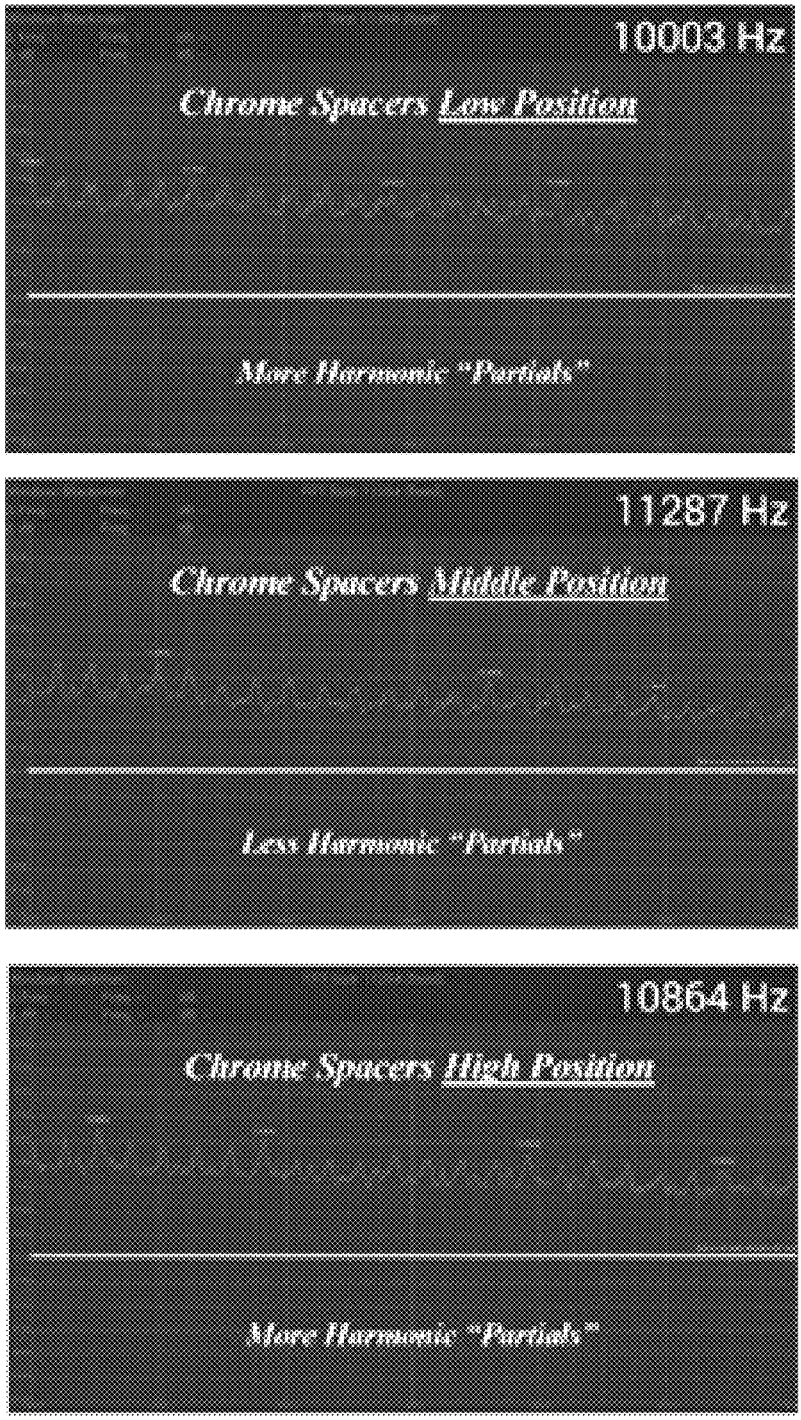
FIGS. 7 and 8 are graphs showing sound frequency variation tested using the reed affixing device for the wind instrument according to the present invention.

FIG. 7 is a graph showing the sound frequency variation as the length of the vibration absorbing region of the cord is adjusted using the pair of sound adjusting members, in which the experiment is performed using the reed affixing device for the wind instrument according to the present invention.

The experiment is carried out under the following conditions.

Each sound adjusting member has on a side thereof five through holes that are in contact with the cord. Here, it is configured such that the through hole has the surface area of about 20 $mm^2$ (2.5 mm*3.14*70%*3.5 mm). The larger the through hole is, the more the sound adjusting effect is. However, the experiment was performed with the through hole of a minimum area in terms of external appearance.

As the experiment device, an oscilloscope for a recording studio was utilized. The experiment method is as follows: tuning is performed in the same A440, and sampling is done in many frequencies within an effective frequency range and the invention is compared with a different ligature which is available in the market. Further, an example equipped with the pair of sound adjusting members was compared with another example having no sound adjusting member.

In conclusion, as shown in FIG. 7, as the length of the vibration absorbing region for absorbing the vibrations of the reed is changed (low position, middle position, and high position), it can be seen that the tone changes considerably. For example, if the pair of sound adjusting members is moved above a midsection, it can be seen that sound is definitely dark.

Figure 8:
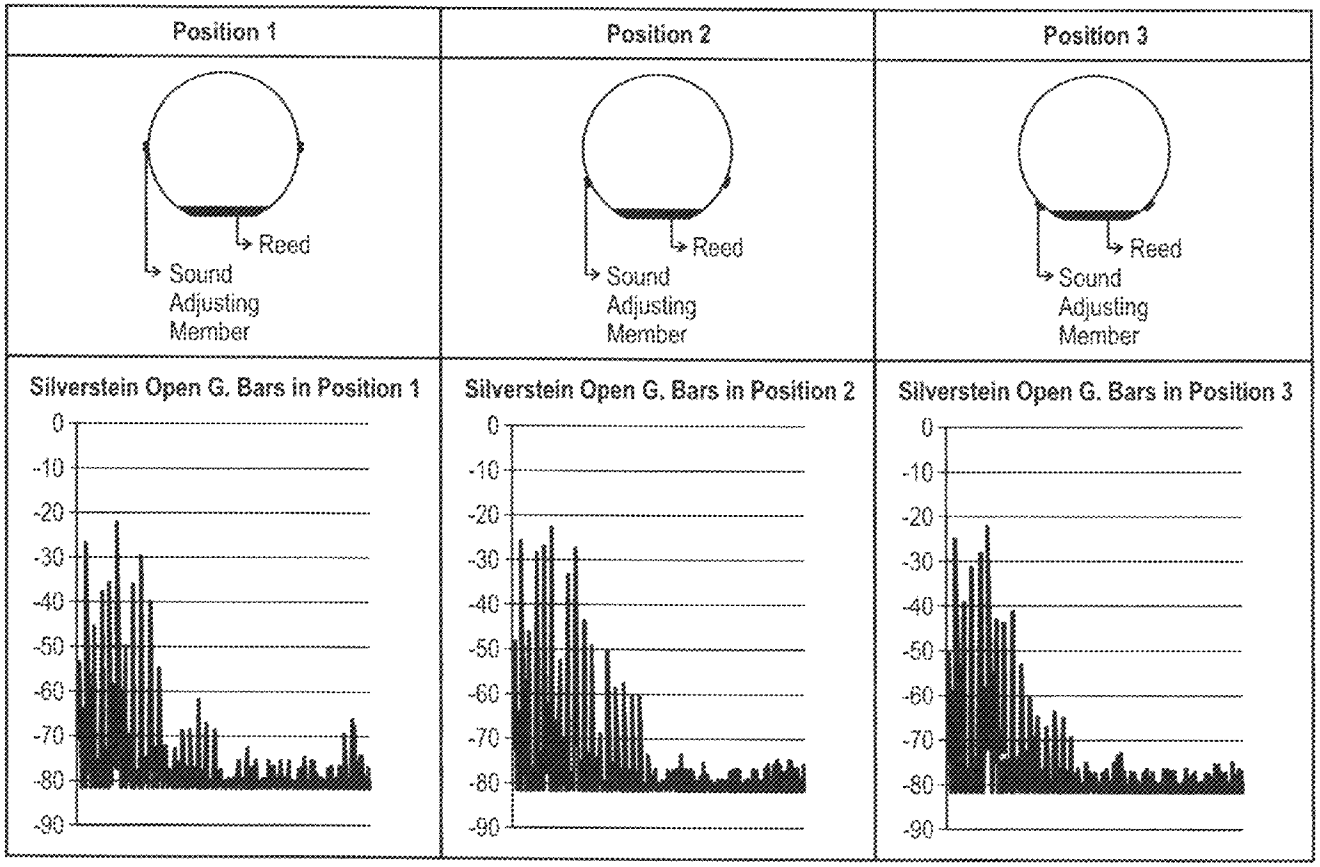

FIG. 8 is a graph showing the sound frequency variation as the length of the vibration absorbing region (position 1, 2 and 3) of the cord is adjusted using the pair of sound adjusting members, in which the experiment is performed using the reed affixing device for the wind instrument according to the present invention.

The experiment is carried out under the following conditions.

The pair of sound adjusting members which are the same as those of FIG. 7 is employed. As the experiment device, a DBX RTA-M microphone (model: PHM919) capable of analyzing voice in real time was utilized, and the output signal was analyzed using the Fast Fourier Transform (FFT) option in Textronix TDS2002B equipment.

The common conditions are as follows when the experiment is performed; an open G was held, checked for consistent audio volume in the time domain and then captured as an FFT trace. A test of audio volume was carried out prior to capturing the FFT trace. The fundamental frequency in all cases is −26 dBV+/−1 dBV.

Therefore, as shown in FIG. 8, it can be seen that the tone is significantly changed depending on the change in length of the vibration absorbing region (position 1, 2 and 3) for absorbing the vibrations of the reed. The respective cases will be described in detail below.

In position 1, the drawing clearly shows the fundamental frequency (at a reference level of approx. −27 dBV), with strong components (varying between −10 and −20 dB of the fundamental) up to the ninth harmonic. Of particular interest is the strength of the $5^{th}$ harmonic, which exceeds the fundamental by 5 dB. Harmonics are also present above the $10^{th}$ but at levels that would be relatively inaudible.

In position 2, the drawing clearly shows the fundamental frequency (at a reference level of approximately −26 dB V), with strong components (varying between −10 and −20 dB of the fundamental) up to the ninth harmonic. Again, of particular interest is the strength of the $5^{th}$ harmonic, which exceeds the fundamental by 3 dB and also the much stronger 3rd and $4^{th}$ harmonics. Harmonics are also present above the $10^{th}$ but this time 10 dB stronger than the levels with the pair of sound adjusting member in position 1.

In position 3, the drawing clearly shows the fundamental frequency (at a reference level of approx. −25 dBV), with strong components (within 20 dB of the fundamental) up to the $8^{th}$ harmonic. Again, the $5^{th}$ harmonic dominates, being 3 dB greater than the fundamental. Also the $3^{rd}$ and $4^{th}$ harmonics have increased considerably being just 7 dB and 3 dB (respectively) less than the fundamental. Harmonics are still present above the ninth, but at levels a little less than obtained with the pair of sound adjusting member in position 2.

As seen from the above experimental result, the pair of sound adjusting members allows a player to play the music with a desired tone.

Figure 10:
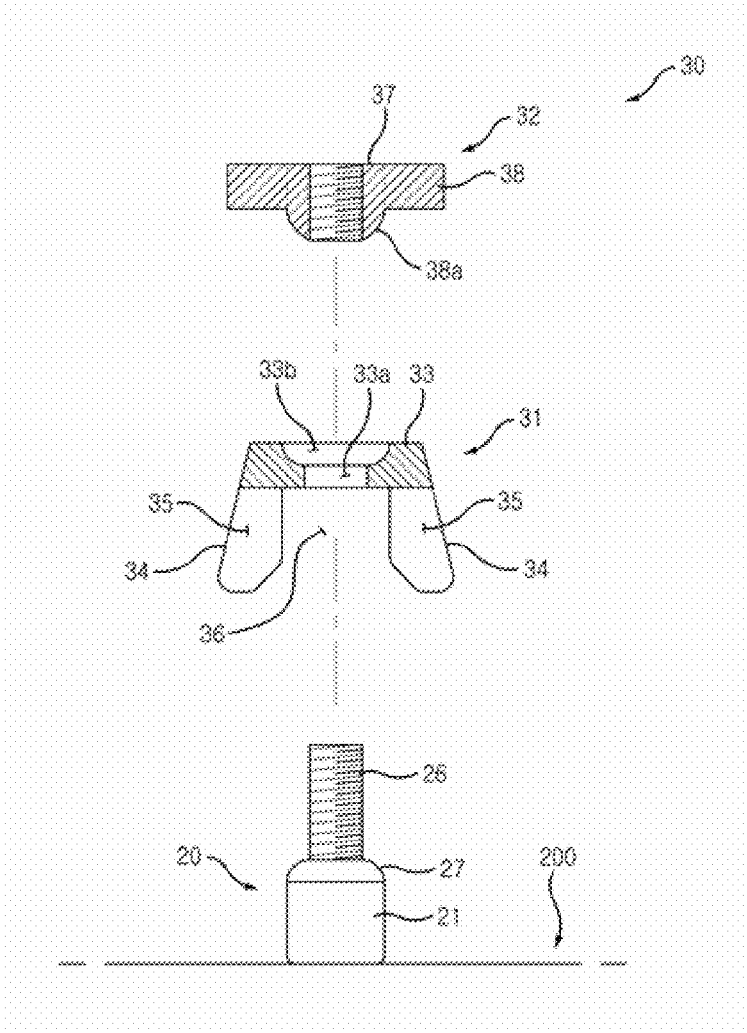
FIGS. 10 and 11 are an exploded view showing an affixing means in the reed affixing device for the wind instrument of FIG. 1, and a view showing a coupled state, respectively.

The affixing means 30 serves to stably hold the puller 21 on the mouthpiece 200. To this end, the puller means 20 further includes a guide bar 26 which extends upwards from an upper portion of the puller 21, with threads formed on an outer circumference of the guide bar 26. As shown in FIGS. 1 and 10, the affixing means 30 may include a bridge 31 that is coupled to the guide bar 26, and a press lever 32 that is fastened to the guide bar 26 in the threaded fastening method and presses the bridge 31 to secure the puller means 20 to the mouthpiece 200.

The bridge 31 has both ends and both side ends. The both ends of the bridge 31 extend in the longitudinal direction of the puller 21. The bridge 31 includes an upper plate 33 having a guide hole 33*a* through which an upper end of the guide bar 26 passes, and a pair of side plates 34 which extend downwards from the both side ends of the upper plate 33, with a plurality of insert grooves 35 formed in the side plates 34 such that the cord 10 is introduced in the form of a spiral. Further, the bridge 31 is closed at both sides and top thereof by the pair of side plates 34 and the upper plate 33, thus defining an inlet space 36 for introducing the puller 21 therein. That is, the pair of side plates 34 is seated at lower ends thereof on the mouthpiece 200, and the puller 21 is introduced into the inlet space 36.

Figure 9:
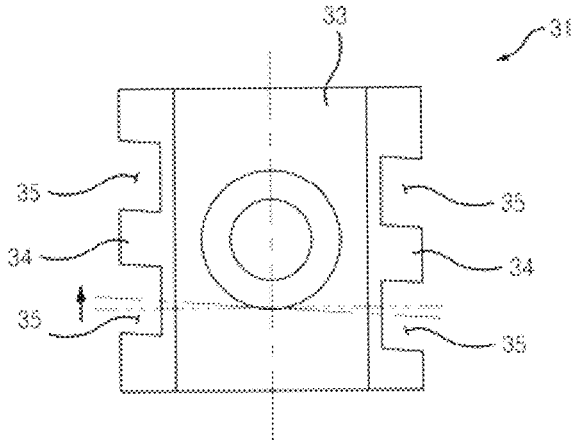
FIG. 9 is a plan view showing a bridge included in the reed affixing device for the wind instrument of FIG. 1.

As shown in FIG. 9, the plurality of insert grooves 35 is formed through the pair of side plates 34. Preferably, each insert groove 35 is inclined towards a first or second end of the upper plate 33 with respect to the state when it is perpendicular to the both ends of the upper plate 33. Such a configuration allows the bridge to be stably seated on the mouthpiece 200 without interfering with the cord 10 wound in the form of a spiral.

As shown in FIG. 10, a coupling depression 33*b* may be formed in a central portion of the upper plate 33 in such a way as to be depressed downwards. Preferably, the guide hole 33*a* is formed in a central portion of the coupling depression 33*b*.

The press lever 32 may include a press piece 37 that has on an inner circumference thereof threads to be fastened to the guide bar 26 in the threaded fastening method, a plurality of adjusting bars 38 that extend outwards from an outer circumference of the press piece 37, and a coupling projection 38*a* that protrudes downwards from a lower portion of the press piece 37 and is coupled to the coupling depression 33*b*.

That is, as the press lever 32 is rotated to be tightened, it moves downwards along the guide bar 26 and presses the bridge 31, thus securing the puller means 20 to the mouthpiece 200. In contrast, as the press lever 32 is rotated to be loosened, it moves upwards along the guide bar 26 and releases the bridge 31, thus releasing the puller means 20 from the mouthpiece 200.

Figure 2:
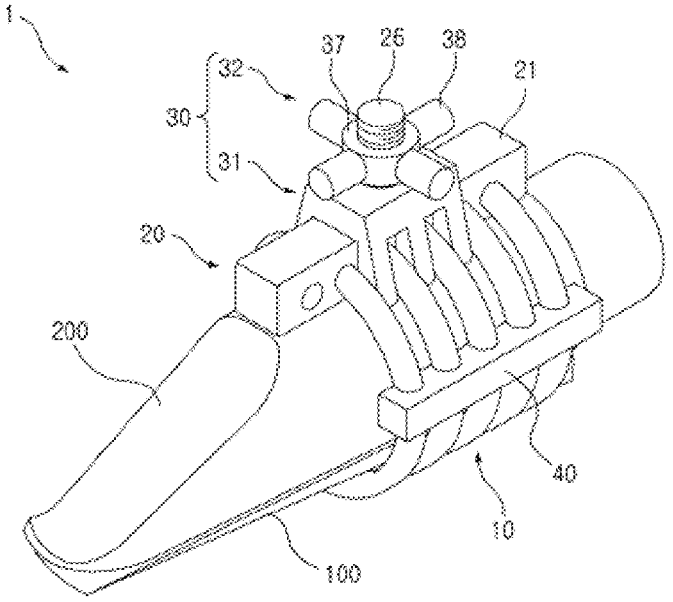

Preferably, as shown in FIGS. 1 to 3, the cord 10 spirally passes through the puller means 10 in a direction opposite to the rotating direction for tightening the press lever 32. That is, if the press lever 32 rotates rightwards to be tightened, the cord 10 rotates leftwards while spirally passing through the puller means 20. The reason is because, when the press lever 32 is turned to be tightened, a rotational moment may be generated by the rotation in a closing direction and thereby the puller means 20 holding the cord 10 may be rotated.

According to the present invention, if the press lever 32 is tightened, a friction portion occurs between the lower surface of the mouthpiece 200 and the cord 10 and resistance to the rotating force occurs at both ends of the cord 10, thus preventing the rotation of the puller means 10.

Preferably, the coupling projection 38*a* has a spherical or hemi-spherical shape, while the coupling depression 33*b* has a shape corresponding to that of the coupling projection 38*a*. This allows the coupling projection 38*a* to be located in the coupling depression 33*b* such that the coupling projection 38*a* is movable forwards, backwards, leftwards, and rightwards within a predetermined range. Thereby, a fastening operation is possible even at different angles. As a result, it is possible to vertically set the puller 21 on the surface of the mouthpiece 200 regardless of the angle of the mouthpiece. The diameter of the guide hole 33*a* is preferably larger than that of the guide bar 26, thus permitting its free movement.

The guide bar 26 has on a lower portion thereof a hemispherical contact projection 27. While the contact projection 27 is located in the inlet space 36, it allows the position of the bridge 31 to be adjusted depending on the surface state of the mouthpiece 200.

Figure 11:
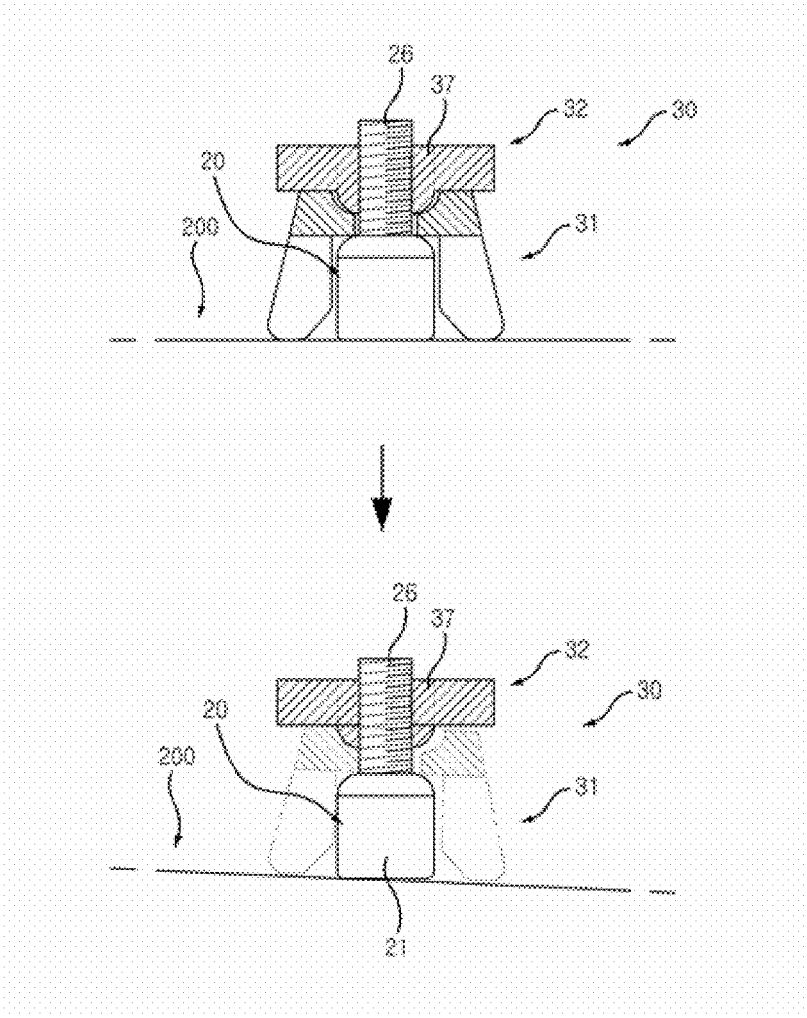

Thereby, as shown in FIG. 11, the reed affixing device 1 for the wind instrument is configured such that the bridge 31 is movable within a predetermined range to adjust its position depending on the top surface state or size of the mouthpiece 200, thus preventing the bridge 31 as well as the mouthpiece 200 from being broken or damaged when they are pressed.

Second Embodiment

Figure 12:
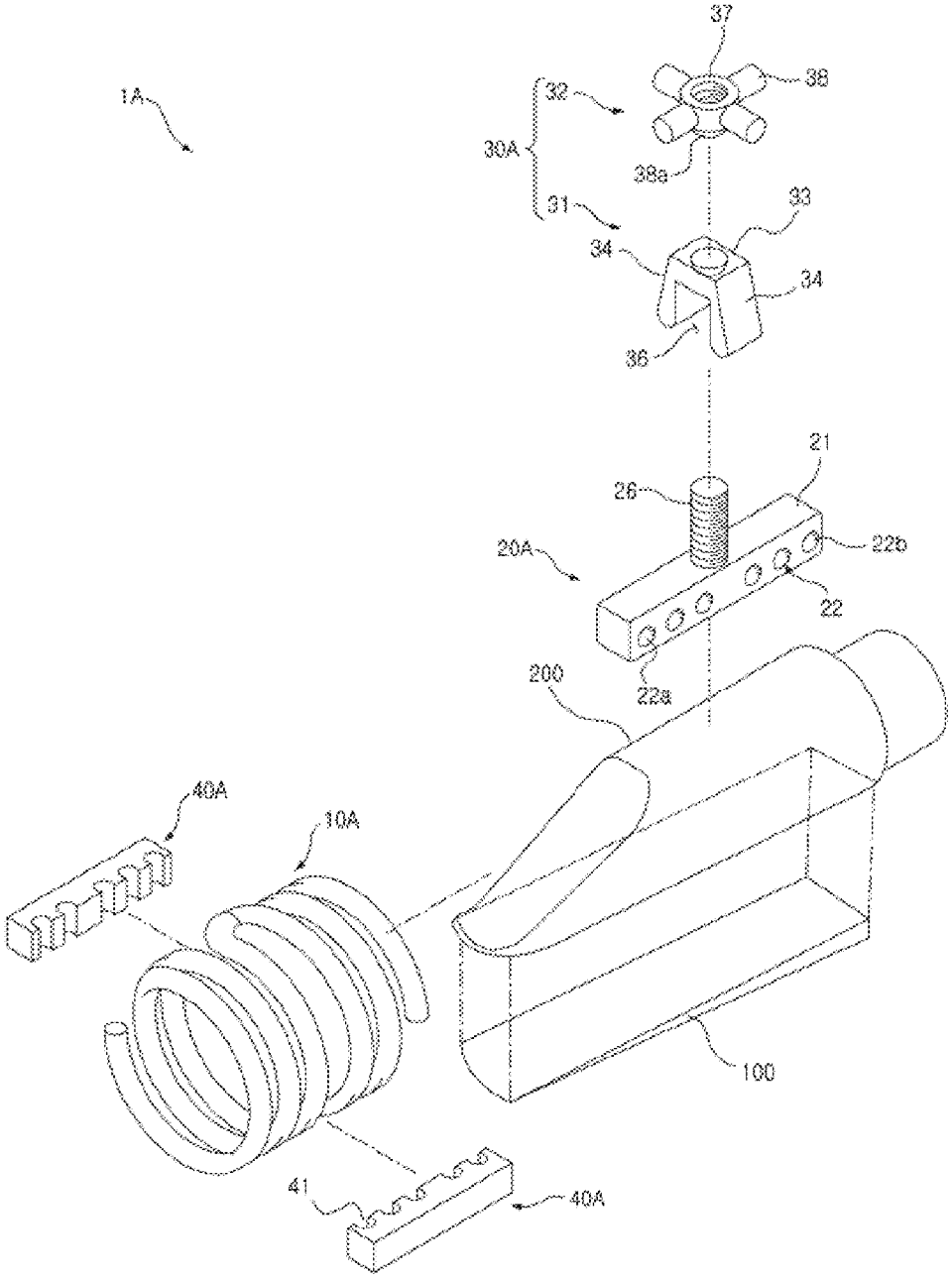
FIGS. 12 and 13 are an exploded perspective view showing a reed affixing device for a wind instrument according to a second embodiment of the present invention, and a view showing the state where a reed is secured to a mouthpiece, respectively.
Figure 13:
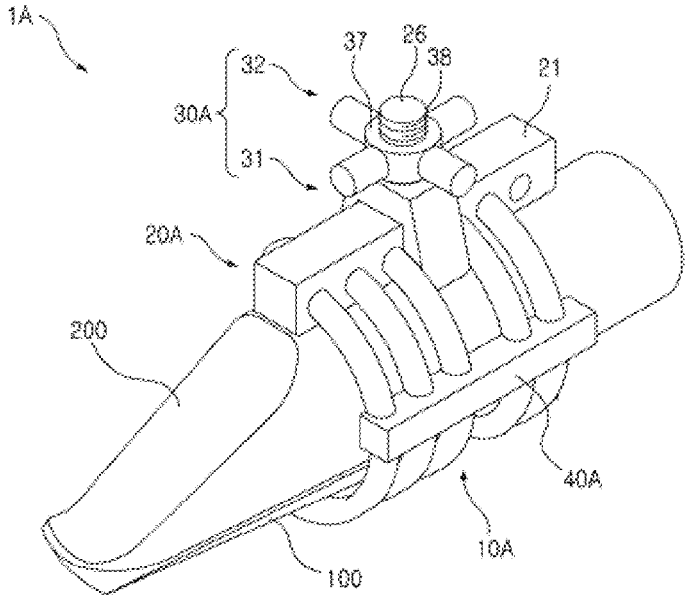

As shown in FIGS. 12 and 13, a reed affixing device 1A for a wind instrument according to the second embodiment of the present invention includes a cord 10A wound around a reed 100 and a mouthpiece 200, a puller means 20A located on an upper portion of the mouthpiece 200, with the cord 10A spirally passing through the puller means 20 in the form of a bidirectional spiral with respect to a central portion of the puller, and an affixing means 30A fastened to the puller means 20A to secure the reed 100 to the mouthpiece 200.

That is, the reed affixing device 1A for the wind instrument according to the second embodiment is equal to the reed affixing device 1 for the wind instrument according to the first embodiment except that the cord 10A is wound around the reed 100 and the mouthpiece 200 in the opposite directions with respect to the central portion of the puller means 20A, so that the shape of the puller means 20A, the affixing means 30A and the sound adjusting member 40A is partially changed. Hence, the detailed description of the second embodiment will be omitted herein.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A reed affixing device for a wind instrument intended to secure a reed to a lower portion of a mouthpiece provided on the wind instrument, the reed affixing device comprising:

puller means disposed on an upper portion of the mouthpiece in a longitudinal direction thereof, and including a puller having a plurality of hollow portions formed in a direction crossing the longitudinal direction of the mouthpiece, wherein each of the hollow portions comprises a protrusion protruding in a curved shape from a lower surface of the hollow portion defining a bottom;

a string-shaped cord passing through the plurality of hollow portions in the form of a unidirectional spiral from a side of the puller to wind around the reed and the mouthpiece at several times, the cord being secured to first and last hollow portions formed, respectively, in both ends of the puller, wherein a height from the protrusion to an upper surface of the hollow portion defines a ceiling equal to or larger than a diameter of the cord;

affixing means fastened to a side of the puller means to secure the reed to the mouthpiece; and a pair of sound adjusting members provided on opposite sides of the mouthpiece in such a way as to be in close contact with the cord that is wound several times, wherein each of the sound adjusting members has a rectangular cubic shape, and comprises on a first side thereof a plurality of through holes to come into close contact with the cord wound several times, the through holes having the same shape, the same surface area, and the same distance to a second side of the sound adjusting member.

2. The reed affixing device as set forth in claim 1, wherein the puller means further comprises:

a pair of threaded holes formed perpendicularly to the first and last hollow portions, and having threads on inner surfaces thereof; and a pair of adjusters coupled to the pair of threaded holes in a threaded fastening method to press and fix the cord.

3. The reed affixing device as set forth in claim 1, wherein the puller means further comprises a guide bar extending upwards from the puller, with threads formed on an outer circumference thereof, the affixing means comprising:

a bridge coupled to the guide bar, the bridge comprising a coupling depression, the coupling depression being depressed in a central portion of the bridge, and a press lever located above the bridge and fastened to the guide bar in the threaded fastening method, the press lever comprising a coupling projection, the coupling projection protruding downwards to be coupled to the coupling depression, and each of the coupling projection and the coupling depression has a spherical or hemi-spherical shape.

4. The reed affixing device as set forth in claim 1, further comprising:

a plurality of cords having various thicknesses that are different from a thickness of the cord; and a plurality of puller means having a plurality of hollow portions that are fit for the cords of the various thicknesses, whereby a player selectively uses a cord and puller means corresponding thereto, according to his or her preference or a kind of an instrument.

5. The reed affixing device as set forth in claim 1, wherein the cord is made of a Kevlar material.

6. The reed affixing device as set forth in claim 1, wherein the puller includes at least one sleeve within a first or a last hollow portion of the plurality of hollow portions, the at least one sleeve coupled to at least one of first and second ends of the cord for securing the end to the puller.

7. The reed affixing device as set forth in claim 1, wherein the puller comprises a pair of adjusting plates that are vertically separated from each other at the both ends thereof, with a space defined between the pair of adjusting plates, and the puller means further comprises a pair of adjusters, the adjusters located on both sides of an upper portion of the puller and rotated to move the pair of adjusting plates towards or away from each other.

8. The reed affixing device as set forth in claim 1, further comprising:

at least one affixing member secured to at least one of the first and second ends of the cord to lock the end to the first or last hollow portion, thus allowing a length of the cord to be adjusted depending on the size of the mouthpiece.

9. The reed affixing device as set forth in claim 1, further comprising:

more than a pair of sound adjusting members provided on opposite sides of the mouthpiece in such a way as to be in close contact with the cord that is wound several times, and adjusting a circumferential interval to the reed, thus adjusting a tone of sound.

10. A reed affixing device for a wind instrument intended to secure a reed to a lower portion of a mouthpiece provided on the wind instrument, the reed affixing device comprising:

puller means disposed on an upper portion of the mouthpiece in a longitudinal direction thereof, and including a puller having a plurality of hollow portions formed in a direction crossing the longitudinal direction of the mouthpiece, wherein each of the hollow portions comprises a protrusion protruding in a curved shape from a lower surface of the hollow portion defining a bottom;

a string-shaped cord passing through the plurality of hollow portions in the form of a bidirectional spiral with respect to a central portion of the puller to wind around the reed and the mouthpiece at several times, the cord being secured to first and last hollow portions formed, respectively, in both ends of the puller, wherein a height from the protrusion to an upper surface of the hollow portion defines a ceiling equal to or larger than a diameter of the cord;

affixing means fastened to a side of the puller means to secure the reed to the mouthpiece; and a pair of sound adjusting members provided on opposite sides of the mouthpiece in such a way as to be in close contact with the cord that is wound several times, wherein each of the sound adjusting members has a rectangular cubic shape, and comprises on a first side thereof, a plurality of through holes to come into close contact with the cord wound several times, the through holes having the same shape, the same surface area, and the same distance to a second side of the sound adjusting member.

11. The reed affixing device as set forth in claim 10, wherein the puller means further comprises:

a pair of threaded holes formed perpendicularly to the first and last hollow portions, and having threads on inner surfaces thereof; and a pair of adjusters coupled to the pair of threaded holes in a threaded fastening method to press and fix the cord.

12. The reed affixing device as set forth in claim 10, wherein the puller means further comprises a guide bar extending upwards from the puller, with threads formed on an outer circumference thereof, the affixing means comprising:

a bridge coupled to the guide bar, the bridge comprising a coupling depression, the coupling depression being depressed in a central portion of the bridge, and a press lever located above the bridge and fastened to the guide bar in the threaded fastening method, the press lever comprising a coupling projection, the coupling projection protruding downwards to be coupled to the coupling depression, and each of the coupling projection and the coupling depression has a spherical or hemi-spherical shape.

13. The reed affixing device as set forth in claim 10, further comprising:

a plurality of cords having various thicknesses that are different from a thickness of the cord; and a plurality of puller means having a plurality of hollow portions that are fit for the cords of the various thicknesses, whereby a player selectively uses a cord and puller means corresponding thereto, according to his or her preference or a kind of an instrument.

14. The reed affixing device as set forth in claim 10, wherein the cord is made of a Kevlar material.

15. The reed affixing device as set forth in claim 10, wherein the puller includes at least one sleeve within a first or a last hollow potion of the plurality of hollow portions, the at least one sleeve coupled to at least one of first and second ends of the cord for securing the end to the puller.

16. The reed affixing device as set forth in claim 10, wherein the puller comprises a pair of adjusting plates that are vertically separated from each other at the both ends thereof, with a space defined between the pair of adjusting plates, and the puller means further comprises a pair of adjusters, the adjusters located on both sides of an upper portion of the puller and rotated to move the pair of adjusting plates towards or away from each other.

17. The reed affixing device as set forth in claim 10, further comprising:

at least one affixing member secured to at least one of the first and second ends of the cord to lock the end to the first or last hollow portion, thus allowing a length of the cord to be adjusted depending on the size of the mouthpiece.

18. The reed affixing device as set forth in claim 10, further comprising:

more than a pair of sound adjusting members provided on opposite sides of the mouthpiece in such a way as to be in close contact with the cord that is wound several times, and adjusting a circumferential interval to the reed, thus adjusting a tone of sound.

* * * * *